US008657069B1

(12) United States Patent
Schwengels

(10) Patent No.: US 8,657,069 B1
(45) Date of Patent: Feb. 25, 2014

(54) EXPANDABLE AND PORTABLE STEP ASSEMBLY

(76) Inventor: Gerald A. Schwengels, Fond du Lac, WI (US)

( * ) Notice: Subject to any disclaimer, the term of this patent is extended or adjusted under 35 U.S.C. 154(b) by 0 days.

(21) Appl. No.: 13/488,414

(22) Filed: Jun. 4, 2012

Related U.S. Application Data

(60) Provisional application No. 61/493,775, filed on Jun. 6, 2011.

(51) Int. Cl.
*A47C 13/00* (2006.01)

(52) U.S. Cl.
USPC ..... 182/33; 182/223

(58) Field of Classification Search
USPC ..... 182/33, 33.5, 33.6, 20, 223; 190/1, 115, 190/18 A; D25/63, 65; D6/349, 350, 353
See application file for complete search history.

(56) References Cited

U.S. PATENT DOCUMENTS

| | | | | | |
|---|---|---|---|---|---|
| 1,280,797 | A | * | 10/1918 | Michenfelder | 182/33.6 |
| 1,681,879 | A | * | 8/1928 | Putnam | 182/33.5 |
| D157,436 | S | | 2/1950 | Rogers | |
| 2,592,912 | A | * | 4/1952 | Knipper | 182/33 |
| 2,861,731 | A | | 5/1957 | Robinson | |
| 3,743,051 | A | * | 7/1973 | Cramer | 182/15 |
| 3,762,742 | A | | 10/1973 | Bucklen | |
| 3,841,437 | A | * | 10/1974 | Caughey | 182/16 |
| 3,954,155 | A | * | 5/1976 | Guidara | 182/20 |
| 4,106,590 | A | * | 8/1978 | Tarran | 182/20 |
| 4,113,161 | A | * | 9/1978 | Manuszak | 294/141 |
| 4,250,977 | A | * | 2/1981 | Deli | 182/33.6 |
| 4,378,862 | A | * | 4/1983 | Carmel | 182/106 |
| 4,471,969 | A | * | 9/1984 | Zabala et al. | 280/30 |
| 4,915,573 | A | | 4/1990 | Wapner et al. | |
| 5,137,294 | A | | 8/1992 | Martin | |
| D331,808 | S | | 12/1992 | Paul et al. | |
| 5,518,084 | A | * | 5/1996 | Short et al. | 182/223 |
| 5,579,864 | A | * | 12/1996 | Shorrock | 182/113 |
| 5,913,562 | A | | 6/1999 | Mattarella et al. | |
| 6,340,189 | B1 | | 1/2002 | Pordy | |
| 6,584,643 | B1 | | 7/2003 | Tomaiuolo | |
| 6,659,485 | B2 | | 12/2003 | Ueno | |
| 6,926,119 | B1 | | 8/2005 | Schrock | |
| 7,086,501 | B1 | * | 8/2006 | Saulet | 182/127 |
| 2006/0243522 | A1 | | 11/2006 | Hart et al. | |
| 2009/0294214 | A1 | * | 12/2009 | Vosbikian et al. | 182/129 |
| 2011/0247898 | A1 | * | 10/2011 | Wigutoff | 182/223 |

* cited by examiner

*Primary Examiner* — Katherine Mitchell
*Assistant Examiner* — Kristine Florio
(74) *Attorney, Agent, or Firm* — Brannen Law Office, LLC

(57) ABSTRACT

The present invention relates to a step assembly whereby the assembly can be deployed wherein person can climb a plurality of steps in a safe and secure manner, and whereby the assembly can be compacted for storage and/or transport. In one embodiment, the step assembly has two pieces hingedly connected to each other. The first piece is taller and wider than the second piece, wherein the second piece can be collapsed into the interior of the first piece for storage. A dual purpose handle is provided, and can be selectably extended into and retracted from the second piece for storage and transport, respectively. The handle can also be inserted into the first piece to act as a railing. A rod is also provided, and can be pivoted from a first position to a second position wherein it can contact a door to prevent the door from unintentionally closing.

18 Claims, 12 Drawing Sheets

EXPANDABLE AND PORTABLE STEP ASSEMBLY

This utility patent application claims priority on and the benefit of provisional application 61/493,775 filed Jun. 6, 2011, the entire contents of which are hereby incorporated herein by reference.

BACKGROUND OF THE INVENTION

1. Field of the Invention

The present invention relates to a step assembly, and in particular to a step assembly having a plurality of pieces, whereby the assembly can be deployed wherein a person can climb the plurality of pieces (each having at least 1 step) in a safe and secure manner, and whereby the assembly can be compacted for storage and/or transport.

2. Description of the Related Art

Steps, step stools, step ladders and the like exist in many forms. Some examples include:

United States Published Application having publication number 2006/0243522 to Hart et al. is titled Portable Stepping Device. It describes a device that has a transportable, platform-like device, lightweight, portable, and strong, for assisting people and animals as they enter and exit vehicles, buildings, etc. The device of the invention generally decreases the distance that a user must step when going from one level to another. Thus, a user who has trouble (due to frailty, illness, agedness, youth) getting in and out of cars or over the threshold of houses may place (or have a caregiver or other companion place) the device immediately in front of the door of a car or house. The user would then step on the device, and then step from the device onto the ground, or into the car or house.

U.S. Pat. No. 2,861,731 to Robinson is titled Folding Porch. It shows a folding or collapsible porch for use with house trailers, construction jobs, aircraft and the like. It appears to fold or collapse onto itself for storage.

U.S. Pat. No. 4,113,161 to Manuszak is titled Combination Carrying Case and Step Unit. It shows a combination carrying case and step unit wherein the case is adapted to contain small articles and is rigid to support the weight of a user standing thereon. The case is provided with means having two operative positions which serves in an extended position to be grasped by a user standing thereon and which has a second retracted position convenient for transport of the case from place to place. A telescopic tube is illustrated in FIG. 6.

U.S. Pat. No. Des. 331,808 to Paul et al. is titled Work Platform, and it illustrates the ornamental design of a work platform.

U.S. Pat. No. 6,926,119 to Schrock is titled Folding Steps. It illustrates a climbing aid for assisting people to move up or down to different levels has steps that can be folded into attached integral handrails that circumscribe the steps when folded so that no parts extend outside of the boundaries of the handrails.

While each of these products may work well for their intended purposes, they each can be improved upon.

For example, none show a device with a hinged connection between steps allowing for stable contact between the assembly and the underlying surface.

None show a device that is rollable.

None show a device that has a dual use handle that allows the device to be transported when in a first position, and then be used as a support rail when in a second position.

None show a device having a door stop to prevent the door from closing onto the user.

None of these devices are intended for use parallel to a vehicle. Rather, they appear to be intended for use in a manner perpendicular to the longitudinal axis of the vehicle. This can be problematic since 1) it can difficult to use the steps operating perpendicular to the vehicle when other vehicles are around, and 2) the stairs can lack sufficient depth to allow the user to turn around on the top step without a sizable risk of tripping or falling.

Thus there exists a need for a step assembly that solves these and other problems.

SUMMARY OF THE INVENTION

The present invention relates to a step assembly, and in particular to a step assembly having a plurality of pieces, whereby the assembly can be deployed wherein a person can climb the plurality of pieces (each having at least 1 step) in a safe and secure manner, and whereby the assembly can be compacted for storage and/or transport.

In one embodiment, the step assembly has two pieces hingedly connected to each other. The first piece is taller and wider than the second piece, wherein the second piece can be collapsed into the interior of the first piece for storage. Each piece has a platform and feet. A dual purpose handle is provided, and can be selectably extended into and retracted from the second piece for storage and transport, respectively. The handle can be removed from the second piece and inserted into the first piece to act as a railing. A rod is also provided, and can be pivoted from a first position (storage) to a second position (upright) wherein the rod can contact a door to prevent the door from unintentionally closing.

In alternative embodiments, the pieces can have similar perimeter dimensions, whereby the pieces become flush with each other in the storage position but do not stack within each other.

In a further alternative embodiment, more than two stepping surfaces can be provided whereby additional height of the largest piece allows for a greater assembly rise height.

In a still further embodiment, the second piece can slide, roll or otherwise be moved into and out of the side of the first piece in a linear manner.

According to one advantage of the present invention, a step assembly is provided with a hinged connection between pieces allowing for stable contact between the assembly and the underlying surface. The hinge allows the individual pieces to flex relative each other to better accommodate any changes in the contour of the underlying surface.

According to another advantage of the present invention, the step assembly is rollably movable when compacted. This advantageously allows for easy transport of the step assembly.

According to a further advantage of the present invention, the step assembly has a dual use handle that allows the device to be transported when in a first position, and then be used as a support rail when in a second position.

Related, the dual use handle advantageously can be retracted within the step assembly for storage.

According to a still further advantage of the present invention, the step assembly has a door stop to contact a vehicle door to prevent it from closing onto the user or step assembly.

According to a still further advantage yet of the present invention, the step assembly is compact when in a storage position, yet is easily deployed to a usable position. Specifically, in many embodiments described hereafter, the step assembly collapses within itself for the storage position.

According to a still further advantage yet of the present invention, non-slip material can cover the step surfaces. Further, the step surfaces have a large surface area, allowing the user to ascend the steps and turn around in a safe manner. This allows, for example, for the user to turn, grab the handle and then sit on the seat of the vehicle with little risk of falling or tripping. In other uses, which are illustratively but not exhaustively recited, the step assembly can be used as a step stool, to get onto and off from medical tables and/or to enter and exit recreational vehicles.

The feet of the step assembly of the present invention can also be covered with non-slip material to prevent the step assembly from slipping during use.

According to a still further advantage yet of the present invention, the step assembly can be used parallel to a vehicle. In this regard, the present invention can be used even when other vehicles are present. Further, the present invention has a top surface with sufficient depth to allow the user to turn around without a sizable risk of tripping or falling.

Still further, in some embodiments, the handle can also function as a door stop.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
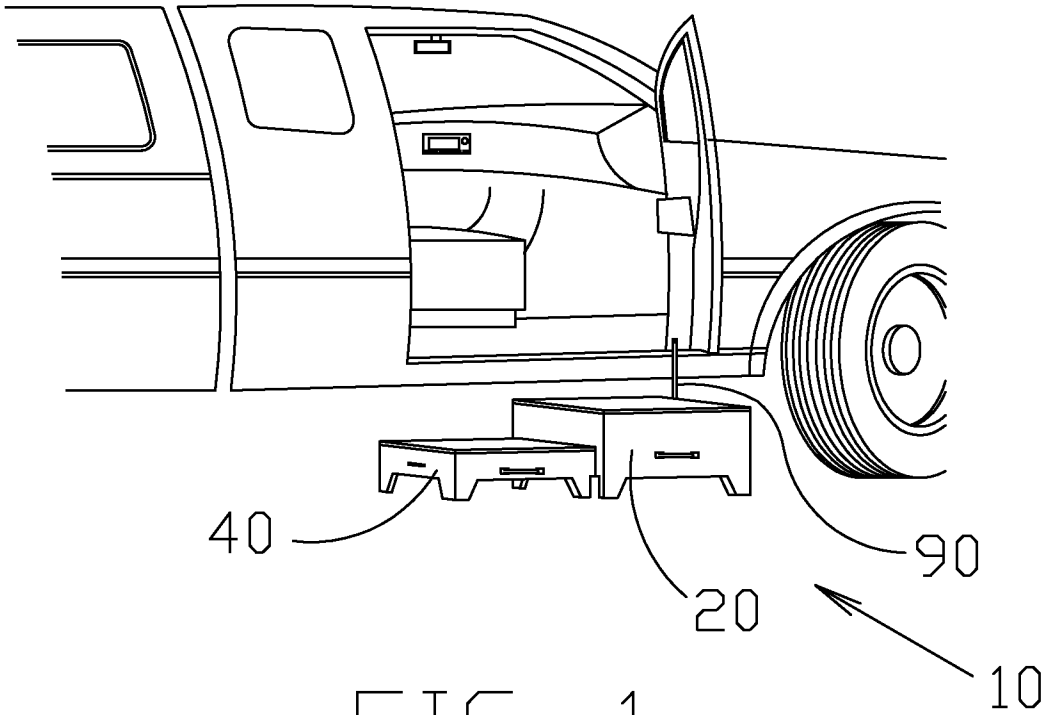
FIG. 1 is a perspective view of an embodiment of the present invention positioned adjacent a vehicle.
Figure 2:
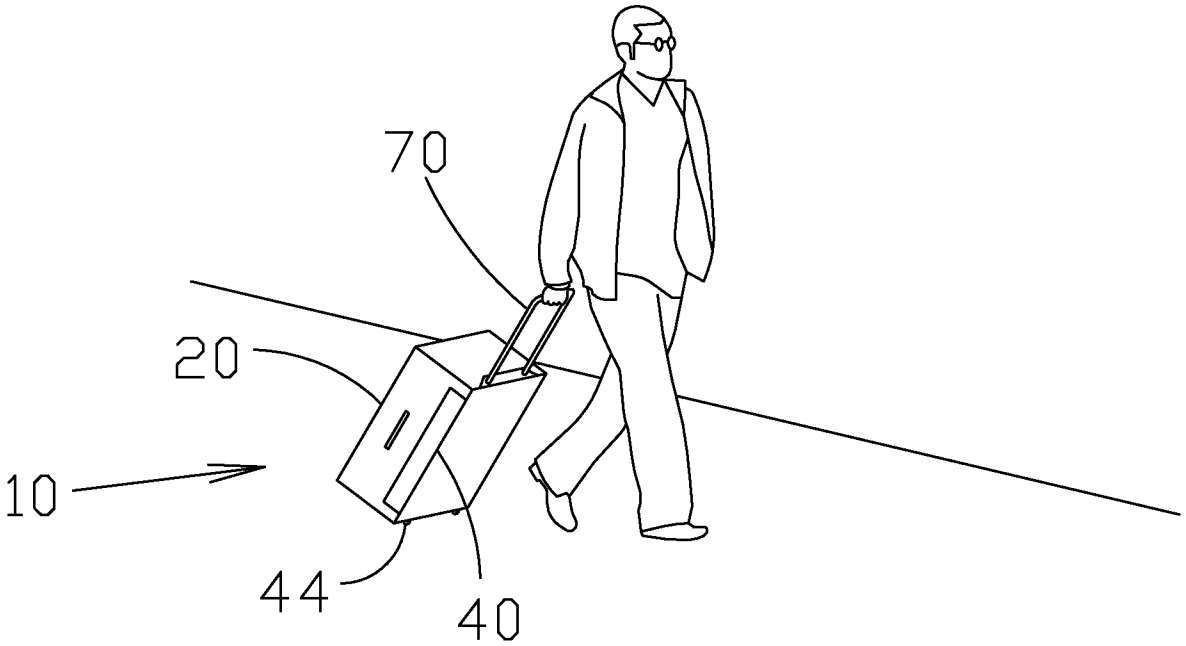
FIG. 2 is a perspective view of a person transporting an embodiment of the present invention, wherein the handle is in an extended position relative the second piece.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Many embodiments are described below. It is appreciated that while sizes, shapes, dimensions and materials may be described herein, that those sizes, shapes and materials are illustrative only and that other sizes, shapes and materials may be used without departing from the broad aspects of the present invention.

Turning now to FIGS. 1-11, it is seen that a first preferred embodiment is illustrated. A step assembly 10 has a first piece 20, a second piece 40, a dual or multi-use handle 70 and a rod 90. Each of these components is described in detail below.

Figure 3:
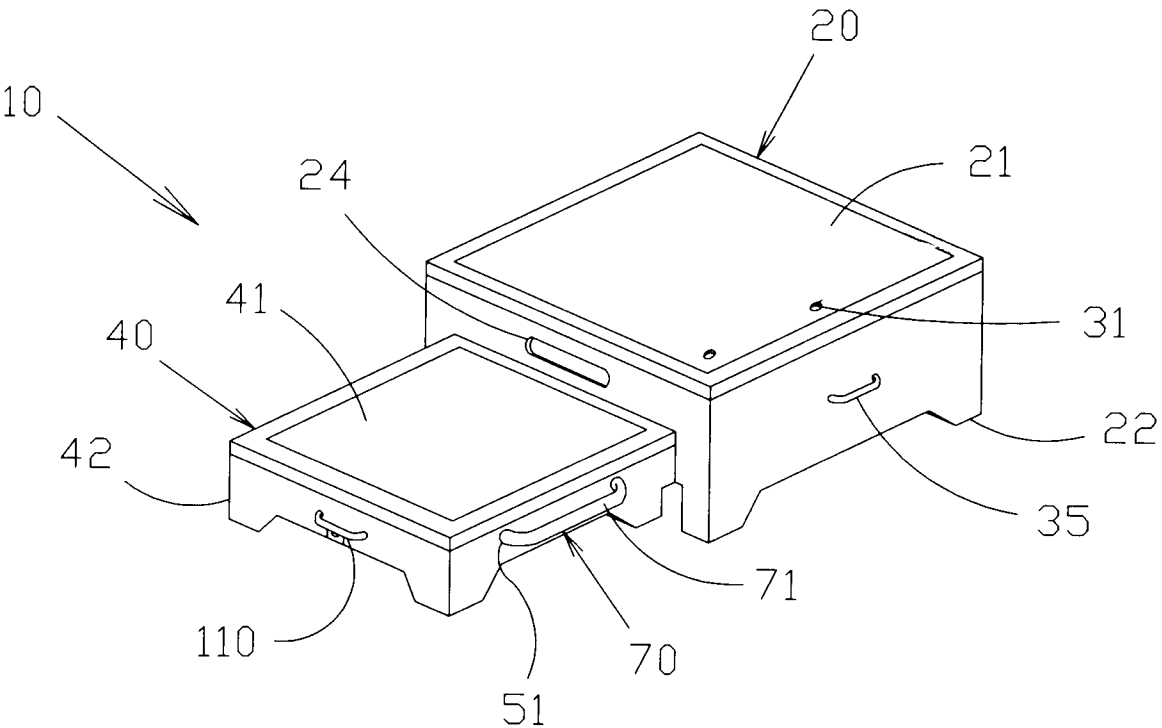
FIG. 3 is a perspective view of an embodiment of the present invention in an open or deployed position.
Figure 5:
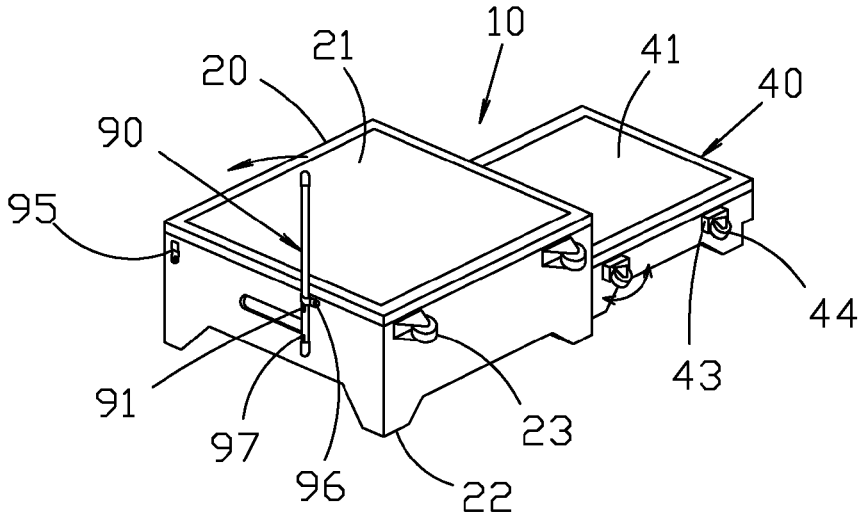
FIG. 5 is an additional perspective view showing the wheels of the present invention and showing the rod in an upright position.
Figure 11:
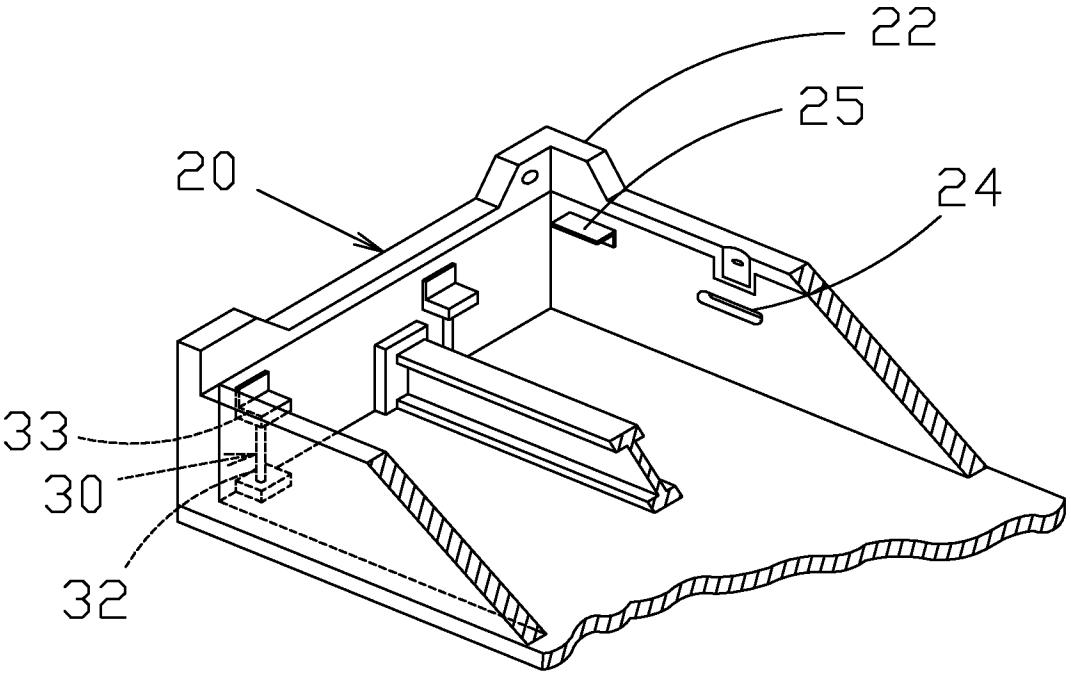
FIG. 11 is a cross-sectional view showing the underside of the first piece.

Turning now to FIGS. 3, 5 and 11, it is seen that the first piece 20 has a surface 21, four feet 22, casters 23, a hand hold 24, a stop bracket 25, a housing 30 having openings 31, support tubes 32 and a brace 33, and a fixed handle 35. The first piece 20 is preferably about 11 inches tall, and the surface 21 preferably has dimensions of 24 inches by 24 inches. The top surface 21 perimeter defines the length and width dimensions of the side walls extending between the surface and the feet 22. There are preferably four feet 22 located at the four perimeter corners of the first piece. The feet located on the hinged side of the first piece can have a rectangular profile to allow for maximum space between the feet. To the contrary, the feet opposite the hinged side can have a generally L-shaped profile to provide increased strength. The surface 21 and feet 22 can be coated with non-slip material to aid in the stability and functionality of the step assembly 10. The perimeter of the surface can be bound with a covering to protect the edge of the non-slip material. The casters 23 preferably are fixed into a linear alignment. The stop bracket 25 supports the second piece (described below) when the step assembly 10 is in a closed position (described below). The housing 30 is located along one of the sides of the step assembly 10 that is parallel with the expansion plane of the step assembly. The hand hole 24 is preferably located on a side that is perpendicular to the expansion plane. The fixed handle 35 is preferably located on the same side as the housing 30. A support can be provided to provide structural support to the underside of the surface 21. The support can have an I-beam configuration.

The sidewalls of the first piece are open between the feet 22, allowing access to the second piece when it is nested within the interior of the first piece 20, and specifically allowing access to the handle 70. Further, the presence of four distinct feet provide an added level of stability to the present invention, since there will be four distinct points to contact the underlying surface.

Turning now to FIGS. 3, 5 and 8-10, is it seen that the second piece 40 is illustrated. The second piece 40 has a surface 41, feet 42, caster support blocks 43 supporting casters 44 and a housing assembly. The second piece is preferably narrower and shorter than the first piece 20 to enable it to nest within the first piece. In this regard, the surface can have dimensions of approximately 20½ inches wide by 22½ inches in length. The feet 42 are preferably L-shaped, and can be located at or near the corners of the second piece 40.

Specifically, the feet 42 on the side closer to the first piece 20 are preferably located inward from the second piece side a distance greater than or equal to the first piece side wall width. This allows the feet to clear the first piece sidewall when the second piece is nested into the first piece. The feet 42 and surface 41 are preferably covered by a non-slip material. The perimeter of the surface can be bound with a covering to protect the edge of the non-slip material. The caster support blocks 43 are preferably about 1½ inch in thickness, so that the casters 44 can be laterally positioned similarly to casters 23 of the first piece 20. Casters 44 are preferably free to rotate or swivel about their respective rotation axis.

The housing 50 of the second piece 40 has openings 51 and two support tubes 52. At least one of the support tubes has a hole laterally there through. A catch assembly 56 with a support block 57 and a lug 58 having a pin 59 there through is shown. A base 60 with a guide 61 and a lock 62 is also shown. The lug 58 is preferably extendable into and retractable from support tube 52 during operation. In this regard, the lug 58 is retractably mounted in support block 57. The pin 59 moves within guide 61 and can be manipulated into lock 62 by twisting it. The distal end of the lug 58 preferably is radiused on a first side and squared on the opposed second side. The opposite radiused (or rounded) and squared edge allows for easier operation in a first direction and less easy operation in the opposed second direction.

Turning now to FIGS. 3, 4, 8 and 10, it is seen that a handle 70 is illustrated. The handle 70 has a bridge 71 and tow sides 75. At least one of the sides 75 has a recess 76 with a taper 77 on one side of the recess, and a distal end 78 with a taper 79 interior of the distal end. It is appreciated that while the handle is shown having a generally round cross section, that other profiles can be used without departing from the broad aspects of the present invention. A grip can be formed into or added to the bridge 71 of the handle 70.

Turning now to FIG. 5, it is seen that a rod 90 is provided. The rod 90 pivots about a pivot 91, and is held in a first position (storage) by a holder 95, and in a second position (deployed) by holders 96 and 97. It is appreciated that while the rod is shown having a generally round cross section, that other profiles can be used without departing from the broad aspects of the present invention.

Figure 6:
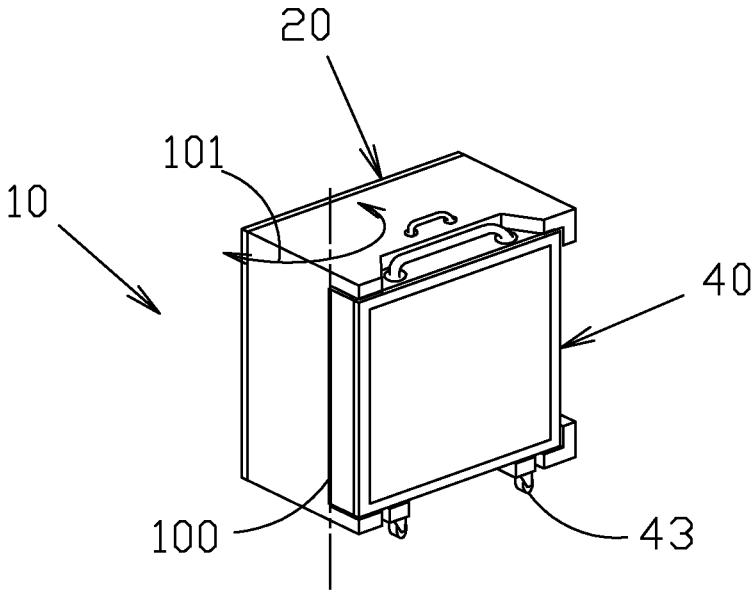
FIG. 6 is a perspective view showing the pieces compacted into each other in the storage position.

A hinge 100 is further provided as seen in FIG. 6. The hinges are operable upon a hinge axis. The hinge axis is generally perpendicular to the expansion plane 101 referenced above. A body latch 110 is further provided, as seen in FIG. 3. The latch 110 is useful to maintain a closed or storage position of the step assembly 10.

Turning now to some of the operative features not heretofore described, the storage position is first described. The step assembly 10 is shown in the storage position in FIGS. 2 and 6. In this regard, the second piece 40 is neatly and securely nested into the interior of the first piece 20. In this regard, the stop bracket 25 (seen in FIG. 11) acts against the outer edge of surface 41 when the second piece 40 is fully nested. The body latch 110 is useful to secure the pieces 20 and 40 in this position. It is seen that casters 44 can be used during transport of the step assembly 10.

The open position is illustrated in FIG. 1 wherein the present invention is shown in one of many intended environments. In the open position, the first piece 20 and second piece 40 are both upright. The second piece 40 has fully swung out of the interior of the first piece 20 wherein both surfaces 41 and 21 respectively are facing the same or nearly the same direction. The hinge 100 allows the first piece 20 to rotate relative the second piece 40 if the contour of the underlying surface is uneven.

Figure 7:
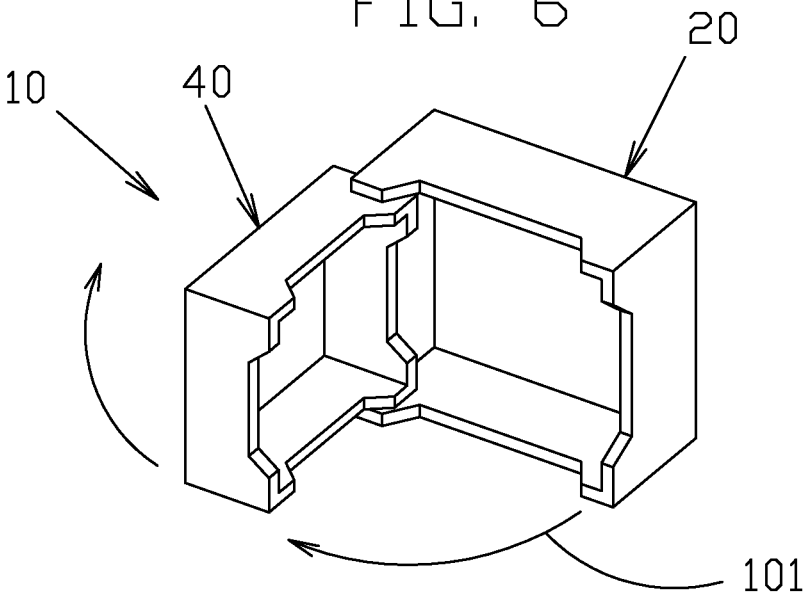
FIG. 7 is a perspective view showing the second piece swiveling relative the first piece in the expansion plane.
Figure 8:
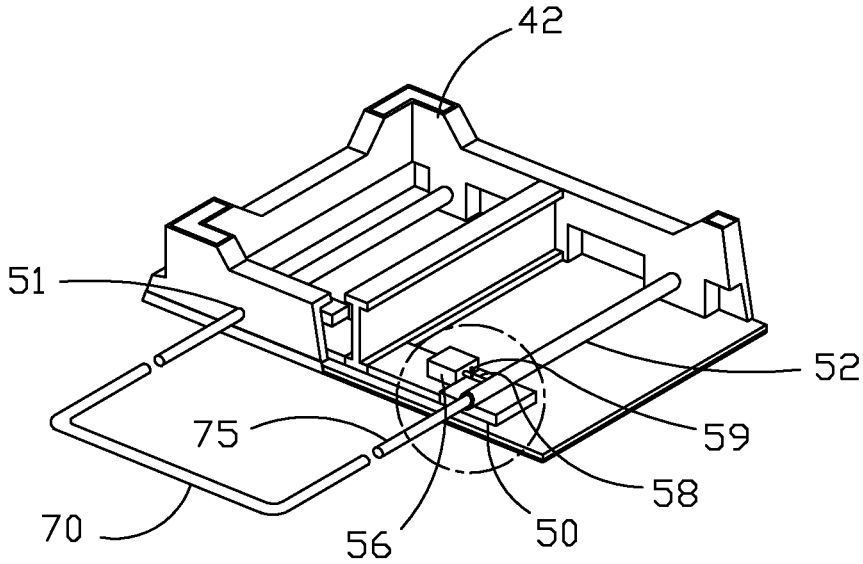
FIG. 8 is a partial cross-sectional view showing the underside of the second piece.
Figure 9:
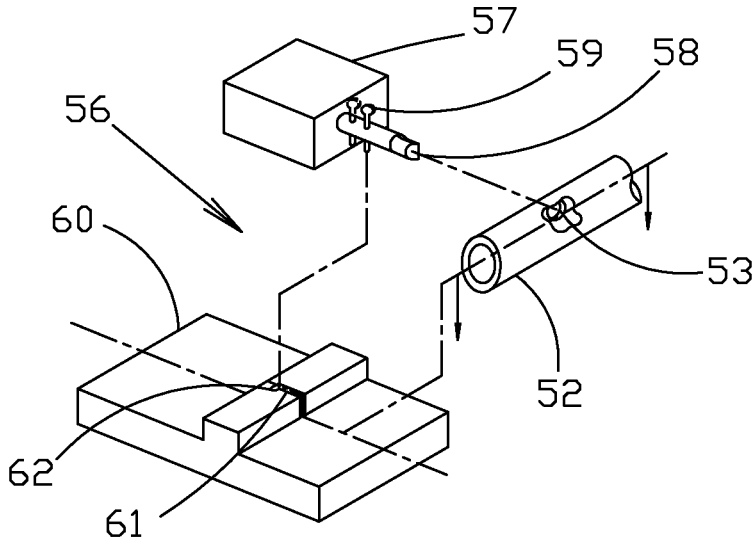
FIG. 9 is an exploded view showing an embodiment of a catch of the present invention.
Figure 10:
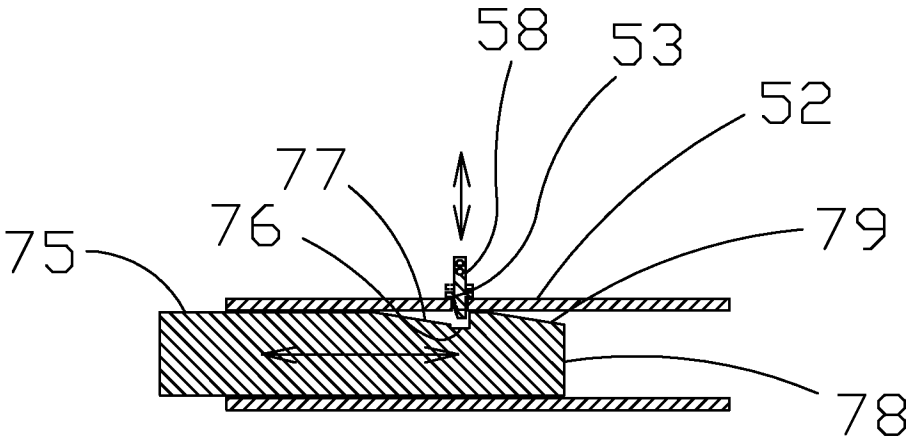
FIG. 10 is a cross-sectional view showing the handle extended to a position relative the housing and interacting with the catch of the present invention.

The step assembly 10 is shown in FIG. 7 in a position intermediate between open (or deployed) and closed (or stored). The expansion plane 101 is illustrated therein as a plane that is generally perpendicular to an axis of rotation between the first and second pieces. While not illustrated in FIG. 7, the casters 23 and 44 are useful in the expansion and compaction of the step assembly 10. Casters 23 hold the first piece 20 stationary while casters 44 freely rotate as the second piece 40 swings relative the first piece 20. It is appreciated that any size caster is usable, and that sizes of two or three inches are preferred.

Figure 4:
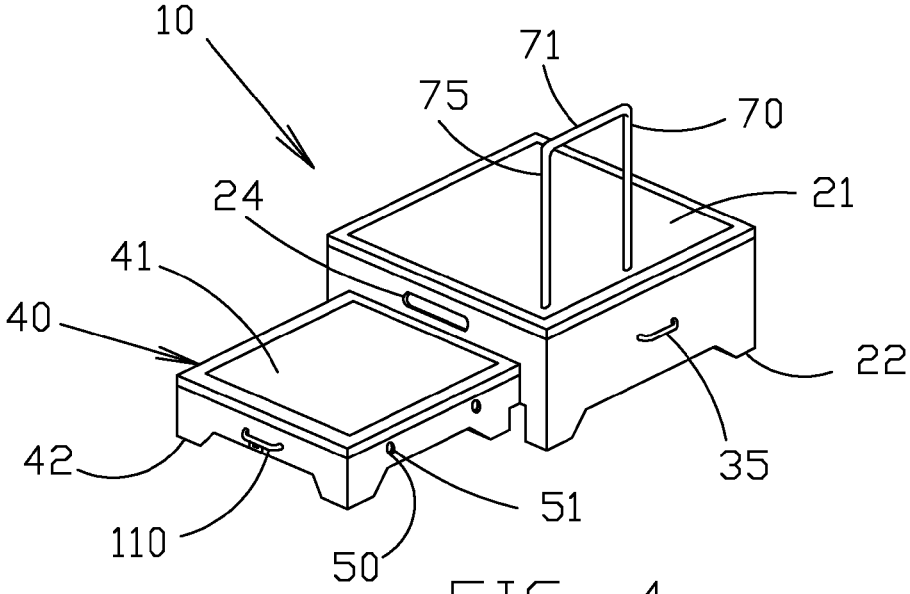
FIG. 4 is similar to FIG. 3, but illustrates a dual use handle shown in position where it is engaging the first piece and acting as a rail.

The handle 70 is a dual or multiple use handle. In one position shown in FIG. 2, the handle can be extended from the second piece 40 and used to transport the step assembly 10. The handle is shown fully retracted into the second piece 40 in FIG. 6 for storage. The handle 70 can be further removed from the housing 50 of the second piece 40 and inserted into the housing 30 of the first piece 20 to act as a railing as seen in FIG. 4 when the step assembly is deployed. In this regard, the handle is useful for stability of the user.

It is appreciated that the catch assembly 56 allows the handle 70 to be fully inserted into the second piece 40, to be held retracted from the second piece and removed from the second piece. Because of the round nature of one side of the lug 58, the handle can easily be moved in a first direction (into the second piece housing 50). Yet, it is appreciated that the squared second side prevents the handle from moving in the opposite direction unless the lug is first manually retracted by the user. It is appreciated that other catch assemblies could alternatively be used without departing from the broad aspects of the present invention.

It is appreciated that the handle can have an alternative form without departing from the broad aspects of the present invention. For example, the handle can be a luggage style handle that extends and retracts from within the assembly. As a further alternative, two handles could be provided, and each could be extendable and retractable from the pieces wherein one could function as a transport device and the other could function as a support device.

Looking now at FIG. 1, it is seen how the rod 90, when pivoted to the open position, can contact the door of an adjacent vehicle to prevent the vehicle door from unintentionally closing.

It is appreciated that handle 70 can additionally act as a door stop instead of rod 90 when the handle 70 is placed in position within the first piece 20.

Figure 12:
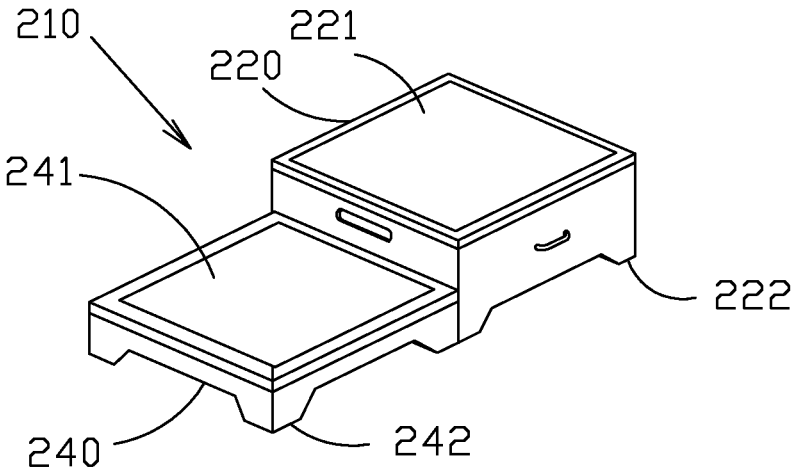
FIG. 12 is a perspective view of an alternative embodiment in the deployed position.
Figure 13:
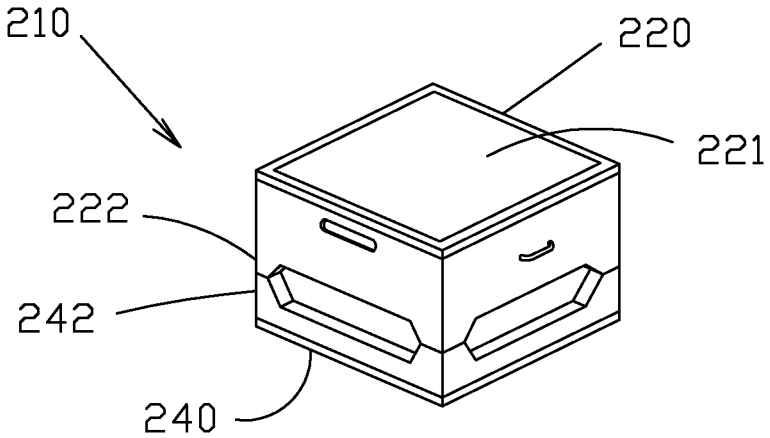
FIG. 13 is a perspective view of the embodiment illustrated in FIG. 12 but shown in a compacted position.

Turning now to FIGS. 12 and 13, it is seen that an alternative embodiment of the step assembly 210 of the present invention is illustrated. In this embodiment, a first piece 220 has a surface 221 and feet 222. A second piece 240 also has a surface 241 and feet 242. The each surface 221 and 241 is preferably square and has dimensions of 24 inches by 24 inches. The first piece 220 can have a rise of 9 inches and the second piece can have a rise of 4.5 inches. In this embodiment, the pieces pivot relative each other to a storage position wherein the feet 242 of the second piece 240 engage the feet 222 of the first piece 220.

Figure 14:
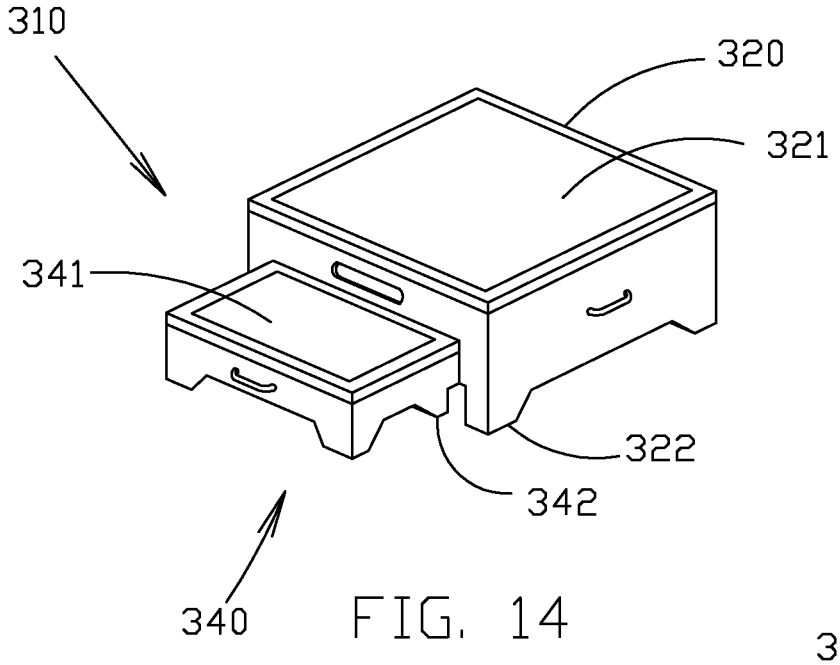
FIG. 14 is a perspective view of an alternative embodiment in the deployed position.
Figure 15:
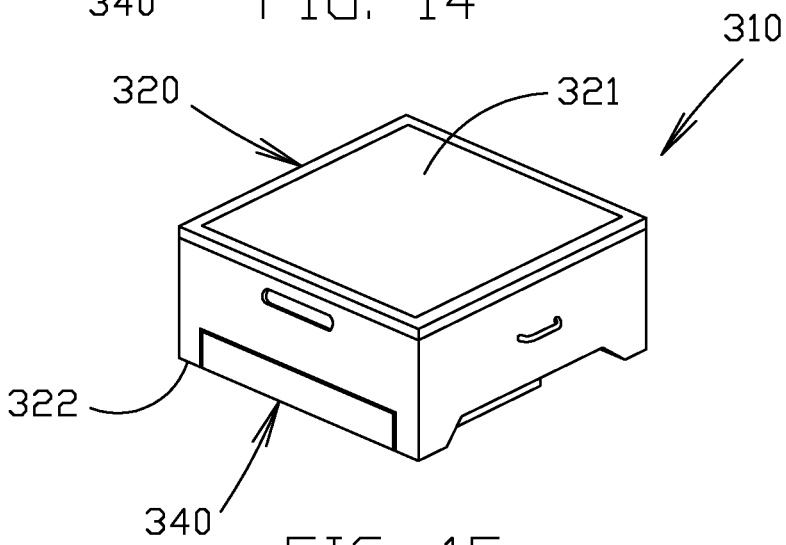
FIG. 15 is a perspective view of the embodiment illustrated in FIG. 14 but shown in a compacted position.

Turning now to FIGS. 14 and 15, it is seen that an additional alternative embodiment is illustrated. Step assembly 310 has a first piece 320 with surface 321 and feet 322. The first surface is approximately 24 inches by 24 inches. Step assembly 310 also has a second piece 340 with surface 341 and feet 342. Surface 340 is approximately 20½ inches wide (sufficiently small to allow nesting within the interior of the first piece) and approximately 12 inches deep. In this regard, the first step is wider than it is deep. The first piece has a height of 11 inches and the second piece can have a height of 5.5 inches.

Figure 16:
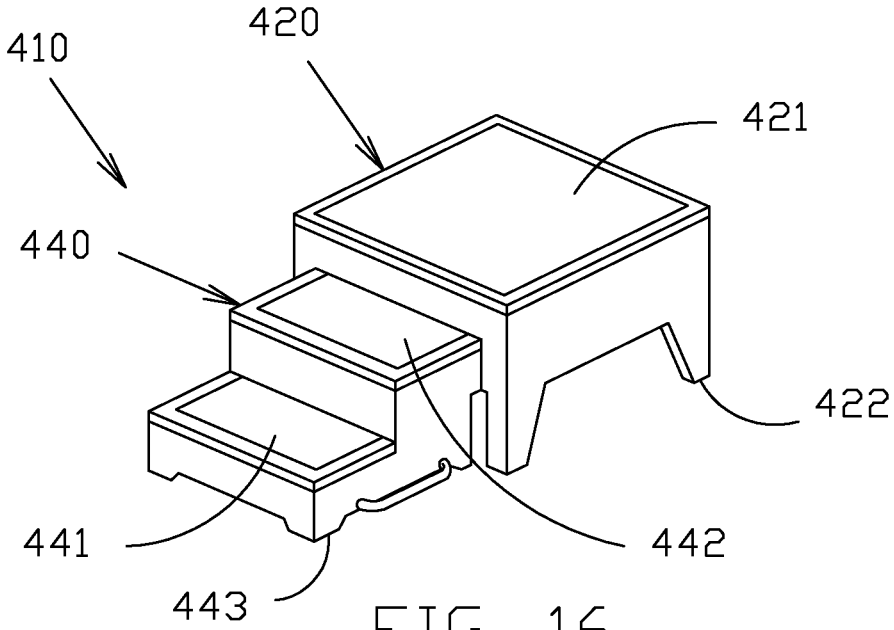
FIG. 16 is a perspective view of an alternative embodiment in the deployed position.
Figure 17:
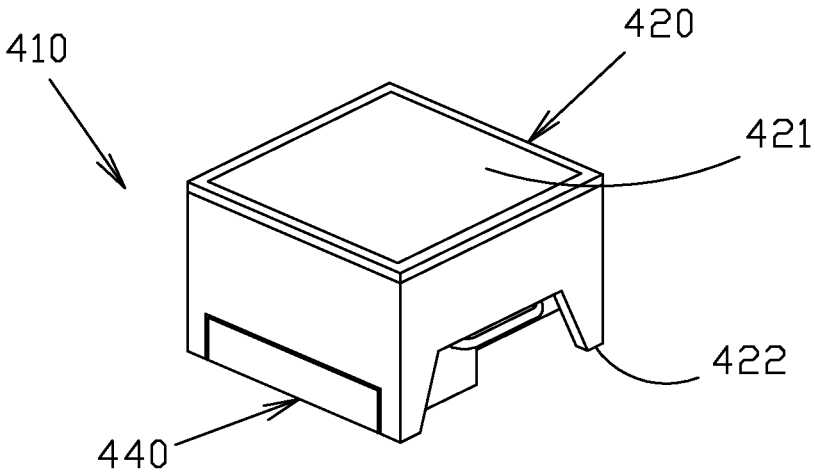
FIG. 17 is a perspective view of the embodiment illustrated in FIG. 16 but shown in a compacted position.

Turning now to FIGS. 16 and 17, it is seen that a still further alternative embodiment is illustrated. In this regard, the step assembly 410 has a first piece 420 and a second piece 440. The first piece 420 has a height of approximately 18 inches, and the surface 421 can be approximately 30 inches by 30 inches. The second piece 440 has a first surface 441 and a second surface 442. Each surface can be about 12 inches by 28 inches. The first surface 441 has a rise of about 6 inches from the bottom of the feet 443, and the second surface 442 has a rise of about 6 inches from the first surface 441. Piece 440 preferably nests within piece 420. Legs of the first piece 420 are preferably sufficiently tall to allow access to the handle retracted within the second piece 440.

Figure 18:
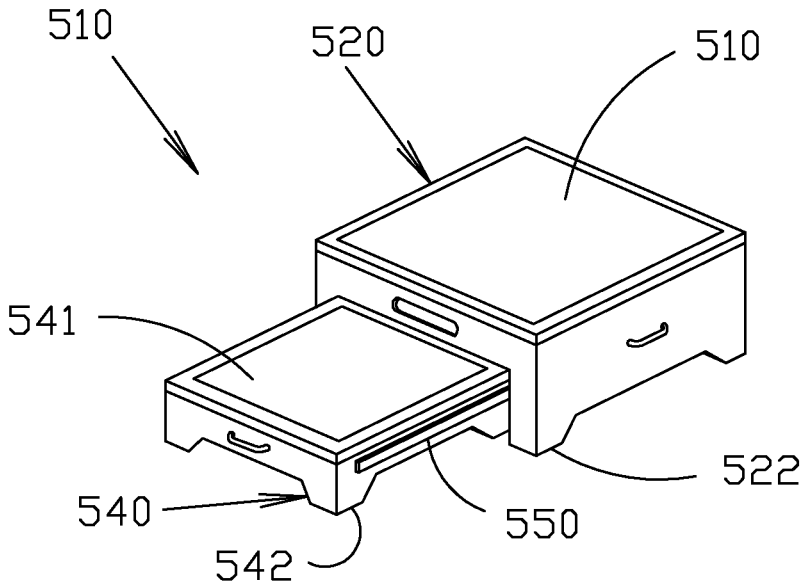
FIG. 18 is a perspective view of an alternative embodiment in the deployed position.
Figure 19:
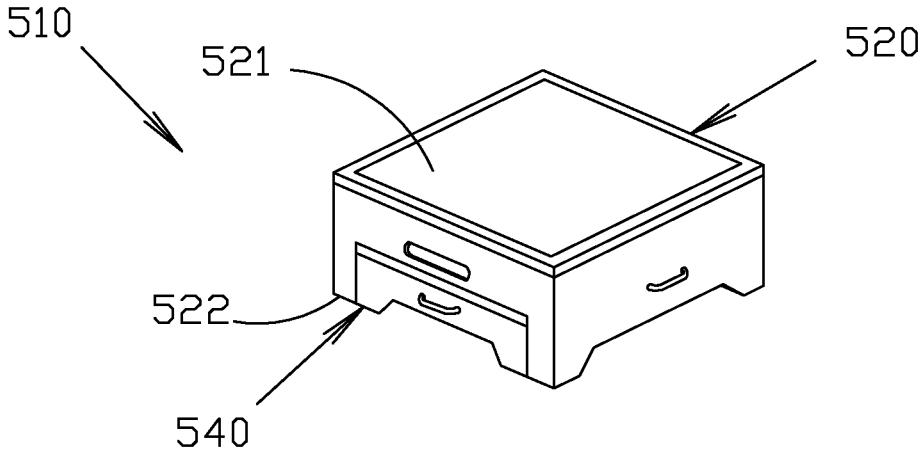
FIG. 19 is a perspective view of the embodiment illustrated in FIG. 18 but shown in a compacted position.

Turning now to FIGS. 18 and 19, it is seen that a still further alternative embodiment yet is illustrated. In this embodiment, a step assembly 510 is provided having a first piece 520 with a surface 521 and feet 522. The surface can be 24 inches by 24 inches. A second piece 540 having a surface 541 that is about 20 inches wide by 22½ inches deep and feet 542 is also provided. A slide assembly 550 can be provided for allowing the second piece 540 to slidably, rollably or movably be selectably extended from the first piece 520.

Thus it is apparent that there has been provided, in accordance with the invention, a step assembly that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A step assembly comprising:

a first piece having a first piece first surface and a first piece height;

a second piece having second piece first surface and a second piece height; and a hinge pivotally connecting said first piece with said second piece, wherein said first piece and said second piece are pivotable from a first position wherein said first piece first surface and said second piece first surface are oppositely oriented to a second position wherein said first piece first surface and said second piece first surface are similarly oriented, whereby said first piece first surface and said second piece first surface creates at least two steps when in said second position, wherein said step assembly further comprises a handle, wherein:

said second piece has a second piece housing with a plurality of second piece housing openings therein allowing said handle to be used for transport when said step assembly is in the first position; and said first piece has a first piece housing with a plurality of first piece housing openings therein allowing for said handle to be used for support when said step assembly is in the second position.

2. The step assembly of claim 1 wherein:

said first piece has a plurality of first piece feet;

said second piece has a plurality of second piece feet;

said hinge allows said second position to occur even when said first piece first surface and said second piece first surface are not exactly parallel due to unevenness of an underlying surface while a majority of said plurality of first piece feet and said plurality of second piece feet engage the underlying surface.

3. The step assembly of claim 2 wherein said first piece is taller and wider than said second piece, wherein said second piece is nested within said first piece when said step assembly is in said first position.

4. The step assembly of claim 3 wherein said second piece feet clear said first piece when said second piece is nested within said first piece.

5. The step assembly of claim 1 wherein said second piece comprises a catch assembly for removably securing said handle to said second piece so that said handle can be used to transport said step assembly without unintentional removal from said second piece.

6. The step assembly of claim 1 further comprising a rod and a holder, said rod being held by said holder in a first rod position for storage, said rod being deployable to a second rod position for use whereby said rod upwardly projects from said first piece.

7. The step assembly of claim 1 wherein said second piece further comprises a second piece second surface, said second piece second surface being generally parallel to said second piece first surface whereby said second piece has two steps.

8. The step assembly of claim 1 further comprising:

a plurality of first piece casters that are fixed in linear alignment with said first piece; and a plurality of second piece casters that are swivelable relative said second piece.

9. A step assembly comprising:

a first piece having a first piece first surface and a first piece height;

a second piece having a second piece first surface and a second piece height; and wherein said first piece and said second piece are movable from a first position for storage to a second position for use, whereby said first piece first surface and said second piece first surface creates at least two steps when in said second position wherein said at least two steps can be oriented along-side a vehicle, wherein said step assembly further comprises a handle, wherein:

said second piece has a second piece housing with a plurality of second piece housing openings therein allowing said handle to be used for transport when said step assembly is in the first position; and said first piece has a first piece housing with a plurality of first piece housing openings therein allowing for said handle to be used for support when said step assembly is in the second position.

10. The step assembly of claim 9 wherein said second piece is slidable relative said first piece, said second piece being slid into said first piece for storage and slid out from said first piece for use.

11. The step assembly of claim 9 further comprising a hinge pivotally connecting said first piece with said second piece.

12. The step assembly of claim 11 wherein said first piece is taller and wider than said second piece, wherein said second piece is nested within said first piece when said step assembly is in said first position.

13. The step assembly of claim 11 wherein said first piece is approximately the same width as said second piece, wherein said second piece is not partially received within said first piece when said step assembly is in said first position.

14. The step assembly of claim 9 wherein said second piece further comprises a second piece second surface, said second piece second surface being generally parallel to said second piece first surface whereby said second piece has two steps.

15. A step assembly comprising:

a first piece having a first piece housing with a plurality of first piece housing openings, a first piece first surface and a first piece height;

a second piece having a second piece housing with a plurality of second piece housing openings, a second piece first surface and a second piece height; and a handle;

wherein:

said first piece and said second piece are movable from a first position for storage to a second position for use whereby said first piece first surface and said second piece first surface creates at least two steps, said handle is usable for transport when said step assembly is in the first position and said handle is received within said plurality of second piece housing openings; and said handle is usable for support when said step assembly is in the second position and said handle is received within said plurality of first piece housing openings.

16. The step assembly of claim 15 wherein said second piece further comprises a catch assembly for removably securing said handle to said second piece so that said handle can be used to transport said step assembly without unintentional removal from said second piece.

17. The step assembly of claim 16 wherein said catch assembly comprises a support block and a lug, said lug being selectably extendable from said support block to engage said handle.

18. The step assembly of claim 17 wherein said lug has a radiused side and a squared side.

* * * * *

UNITED STATES PATENT AND TRADEMARK OFFICE

CERTIFICATE OF CORRECTION

PATENT NO. : 8,657,069 B1
APPLICATION NO. : 13/488414
DATED : February 25, 2014
INVENTOR(S) : Gerald A. Schwengels It is certified that error appears in the above-identified patent and that said Letters Patent is hereby corrected as shown below:

IN THE CLAIMS:

Column 7, Line 40, in Claim 1, please delete “having second piece” and insert -- having a second piece -- therefore.

Signed and Sealed this
Twelfth Day of May, 2015

Michelle K. Lee

Michelle K. Lee
*Director of the United States Patent and Trademark Office*